US007048276B2

(12) United States Patent
Obkircher et al.

(10) Patent No.: US 7,048,276 B2
(45) Date of Patent: May 23, 2006

(54) FLYING DEVICE FOR IR FLYING TARGET REPRESENTATION

(75) Inventors: Bernt Obkircher, Horgenzell (DE); Juergen Steinwandel, Uhldingen (DE); Markus Heller, Uhldingen (DE); Rainer Willneff, Markdorf (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 10/383,000

(22) Filed: Mar. 7, 2003

(65) Prior Publication Data

US 2003/0197332 A1 Oct. 23, 2003

(30) Foreign Application Priority Data

Mar. 9, 2002 (DE) ..... 102 10 433

(51) Int. Cl.
*F41J 9/08* (2006.01)
*G01J 1/00* (2006.01)

(52) U.S. Cl. ..... 273/360; 250/495.1

(58) Field of Classification Search ..... 273/360, 273/361, 348.1; 200/495.1; 244/33, 162; 239/265, 19
See application file for complete search history.

(56) References Cited

U.S. PATENT DOCUMENTS

| | | | | |
|---|---|---|---|---|
| 1,293,869 | A * | 2/1919 | Murray et al. | 244/3.3 |
| 2,828,603 | A * | 4/1958 | Laucher | 60/761 |
| 2,933,317 | A | 4/1960 | Pittinger et al. | |
| 3,001,739 | A * | 9/1961 | Faget et al. | 244/162 |
| 3,774,871 | A | 11/1973 | Semmes et al. | |
| 4,063,685 | A * | 12/1977 | Jacobs | 239/265.17 |
| 4,410,150 | A * | 10/1983 | Lahti | 244/53 R |
| 4,607,849 | A * | 8/1986 | Smith et al. | 273/348.1 |
| 5,317,163 | A | 5/1994 | Obkircher | |
| 5,511,745 | A * | 4/1996 | Faupell et al. | 244/3.22 |
| 5,806,791 | A * | 9/1998 | Hatalsky et al. | 244/3.24 |
| 6,140,658 | A * | 10/2000 | Jarvinen | 250/495.1 |

FOREIGN PATENT DOCUMENTS

| | | |
|---|---|---|
| DE | 4024263 C1 | 8/1991 |
| EP | 0568436 A1 | 11/1993 |
| EP | 0 876 579 | 11/1998 |
| GB | 2309290 A | 7/1997 |
| WO | 00/29804 | 5/2000 |

* cited by examiner

*Primary Examiner*—Mark S. Graham
(74) *Attorney, Agent, or Firm*—Crowell & Moring LLP

(57) ABSTRACT

A flying device for IR flying target representation with at least one infrared radiator (2). An infrared radiator (2) is arranged inside the exhaust gas flow of a convected heat-generating unit so that the exhaust gas stream completely encloses the surface of the infrared radiator (2) exposed to airflow.

10 Claims, 4 Drawing Sheets

FLYING DEVICE FOR IR FLYING TARGET REPRESENTATION

BACKGROUND AND SUMMARY OF THE INVENTION

This application claims the priority of German Application 102 10 433.6, filed Mar. 9, 2002, the disclosure of which is expressly incorporated by reference herein.

The invention concerns a flying device for IR flying target representation with at least one infrared radiator.

Unmanned flying devices are used as flying targets for purposes of practice for ground-to-air or air-to-air weapons systems with infrared (IR) guidance. These flying devices can be towed flying objects or drones. They should not only simulate the kinetic properties of real targets (for example, combat aircraft), but should also have the same infrared (IR) irradiation.

Towed flying objects and target drones are known that generate the desired IR irradiation with so-called tracking flares. These have the disadvantage that they are perceptible in the visual range and draw a smoke plume behind them. Above and beyond this, the spectral characteristics of these flares are not adapted to the irradiation of the real targets. Moreover, unevenness in the burning off of the flare provides undesired tracking problems in the IR seeker head.

A target drone is known from European Patent EP 0 876 579 B1 that generates an IR irradiation by a burner built into the nose of the drone, heating the nose from inside. The heated nose serves as an infrared radiator. The disadvantage (in addition to the expensive burner construction and the complicated air intake and exhaust system for assuring a stable combustion) is that the nose is cooled intensively from the outside by the slipstream so that very high heat outputs are necessary to obtain a sufficient IR irradiation.

Furthermore, an IR target flying object is known from WO 00/29804, in which the IR irradiation is generated by passing hot gas from the propulsion unit through a line into the nose of the flying device and/or the leading edge of the wings and/or into the outer pods of the flying device owing through which these parts are heated from within and in this way become infrared radiators. In addition to the complex structure, it is also disadvantageous in this case that the parts heated by the slipstream are cooled from the outside so that, overall, only small IR irradiations can be obtained.

The object of the invention is to create a representative flying device for IR flying target representation that is simple and economical in construction and has high efficiency for IR irradiation with respect to the heat output to be expended.

The flying device of the present invention improves the prior art by having the infrared radiator arranged inside the exhaust stream of a convected heat-generating unit such that the exhaust stream completely surrounds the surface of the infrared radiator that is exposed to the air current. The flying device can be a towed or can be an independently propelled flying object.

One advantage of the flying device of the invention is that cooling of the infrared radiator by the cooling slipstream is avoided. This is, in particular accomplished, because the surface of the infrared radiator, that is otherwise subjected to the slipstream (air current) in flying operation and consequently would be cooled is surrounded by the exhaust stream in accordance with the invention. The exhaust stream consequently fulfills not only the objective of heating the infrared radiator, i.e. the components that are to serve as infrared radiators, but the exhaust stream also serves as a type of protective casing around the hot infrared radiator, as well.

A further advantage of the flying device of the invention is that, using the infrared radiator arranged according to the invention, IR irradiation is possible in almost any desired direction. Thus, it is, possible, for example, to realize forward, backward and lateral irradiation when viewed in the direction of flight in each case.

The heat-generating unit can advantageously be a propulsive unit of the flying device or an additional burner, especially a gas burner. In a preferred embodiment the propulsive unit, is an aircraft gas turbine or a driving internal combustion motor.

In an advantageous construction of the flying device of the invention, the IR radiator is a component that extends along the direction in which the exhaust stream is propagated and has a cross-like or star-shaped cross section. But it is also possible that in a further advantageous construction of the flying device of the invention that the infrared radiator is a conical component, the axis of which extends along the direction of propagation of the exhaust stream. Of course, it is possible that the infrared radiator also consists of several parts, for example, several plates, especially thin sheets that are suitably joined with one another.

The infrared radiator advantageously consists of a temperature-resistant material, for example, high-grade steel or ceramic. These materials can be heated up to temperatures far above the usually expected exhaust gas temperatures of heat-generating units. For example, in using aircraft gas turbines as propulsive units and consequently as heat-generating units for heating an infrared radiator, the exhaust gas temperatures are, according to the output class (some 10 N to 100 N thrust), at 400–800° C. It should be mentioned here that the exhaust gas of an aircraft gas turbine or an internal combustion motor is quite hot at the indicated temperatures, but is unsuited as an infrared radiator in the medium IR range from 3–5 μm. Within this wavelength range, the exhaust gas is almost transparent when viewed crosswise in relation to the direction of irradiation and consequently hardly emits. The heat of the exhaust gas can thus only be used indirectly since a solid is being heated which then supplies the desired IR irradiation in accordance with its temperature.

The components used as IR radiators advantageously have a surface with a high emission capacity in the infrared spectral range. In this way, the irradiation behavior of the components can be adjusted with respect to the irradiated infrared wavelength range. This is advantageously attained by having the surface of the components coated with an electrically insulating material.

By changing the material thickness of the components used as IR radiators, the heat transport within the material and therefore the temperature distribution on the surface can be changed to provide a higher IR irradiation. Thus, overall higher IR total irradiations can be expected from a material with low heat conductivity.

Moreover, by changing the exhaust gas temperature, the temperature of the infrared radiator and consequently IR irradiation can be influenced. This can, for example, be attained with the use of an aircraft gas turbine as a heat-generating unit using an internal control unit that brings about an increase in exhaust temperature through alternation of the cross section surface of the outlet nozzle of the turbine.

The IR irradiation of the infrared radiator can obviously also be influenced by the geometric magnitude of the components placed in the exhaust gas stream. Moreover, when using propulsive units as heat-generating units, the IR irradiation of the components can also be influenced by an exhaust system of the propulsion unit adjusted to the components.

In an advantageous construction of the flying device of the invention, the heat-generating units with their IR radiators arranged in the exhaust gas stream are fastened in front of the nose on the long axis of the flying device and/or on the tail and/or on the lifting surfaces and/or on the fuselage of the flying device.

If the heat-generating unit with the IR radiator is fastened in front of the nose on the longitudinal axis of the flying device, the IR radiator is constructed conically or substantially conically so that a relatively low aerodynamic resistance results. In an advantageous construction of the flying device, the nose itself is constructed conically or substantially conically and as an IR radiator. With this arrangement, IR irradiation is possible in the flight direction of the flying device and also in a lateral direction according to the generating angle of the conical IR radiator. If the heat-generating unit with the IR radiator is fastened on the tail and/or on the lifting surfaces and/or on the fuselage of the flying device, the IR radiator is appropriately a suitable component that extends along the direction of propagation of the exhaust gas stream and has a cross-shaped or star-shaped cross section. The component thus has low aerodynamic resistance that diminishes thrust only to a minor extent when using a propulsive unit as a heat-generating unit. With this arrangement, lateral IR irradiation is possible-in relation to the direction of flight.

When using at least three propulsive units as heat-generating units, the propulsive units can advantageously be oriented under a specifiable angle toward the long axis of the flying device, so that the overall impulse of these propulsive units is directed along the long axis of the flying device. In this way, in addition to an IR irradiation component toward the side, there also results an IR irradiation component toward the front and back (in any given case, viewed in the flight direction of the flying device).

Of course, it is also possible to provide a propulsive unit with IR radiator in front of the nose of the flying device and further propulsive units on or in the fuselage of the flying device.

Other objects, advantages and novel features of the present invention will become apparent from the following detailed description of the invention when considered in conjunction with the accompanying drawings.

BRIEF DESCRIPTION OF THE DRAWINGS

The invention, as well as advantageous constructions of the invention, will be explained in greater detail on the basis of drawings, in which.

DETAILED DESCRIPTION OF THE PREFERRED EMBODIMENT

Figure 1B:
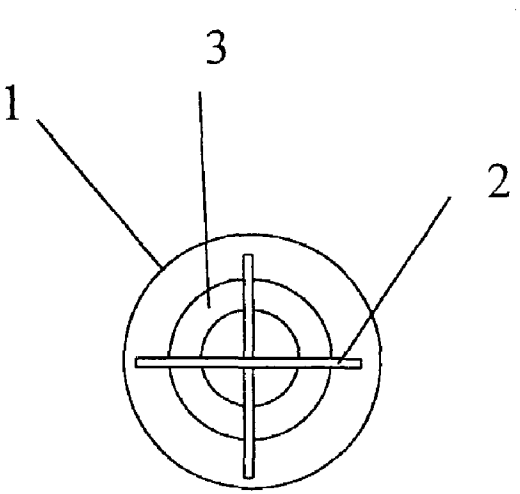
FIGS. 1*a* and 1*b* show the arrangement of an IR radiator in the exhaust gas stream of a heat-generating unit in perspective lateral view in a first design.
Figure 1A:
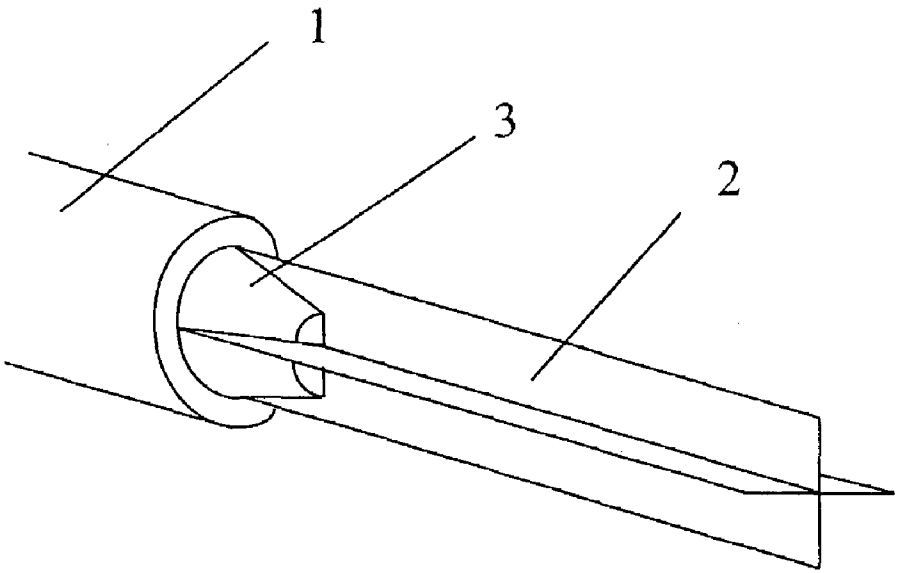

In FIG. 1*a*, a heat-generating unit, for example an aircraft gas turbine 1, is shown schematically in perspective elevation, with an IR radiator 2 situated in the exhaust stream (not represented). The IR radiator 2 is connected with the nozzle 3 of the turbine 1. Obviously it is also possible to position the IR radiator 2 in another manner in the exhaust stream of the turbine 1 taking aerodynamic aspects into consideration, for example, using support poles.

The IR radiator 2 is constructed as a so-called cross sheet. That is, thin sheets with small wall thickness, for example, 0.2–1 mm, are suitably joined with one another, for example welded or inserted into one another, such that the cross section of the IR radiator, as represented in FIG. 1*b*, is cross-shaped. FIG. 1*b* also shows IR radiator 2 which is aerodynamically inserted into the exhaust stream of turbine 1 so that the thrust of the turbine is negligibly diminished. Moreover, it should be recognized in both representations of FIGS. 1*a* and 1*b* that IR radiator 2 is situated inside the exhaust gas flow. Consequently, the IR radiator 2 is subjected completely to flow around by the hot exhaust gas stream and heated up. An IR irradiation in the lateral direction as well as upward and downward viewed in the direction of flight of the flying device is guaranteed.

Figure 2:
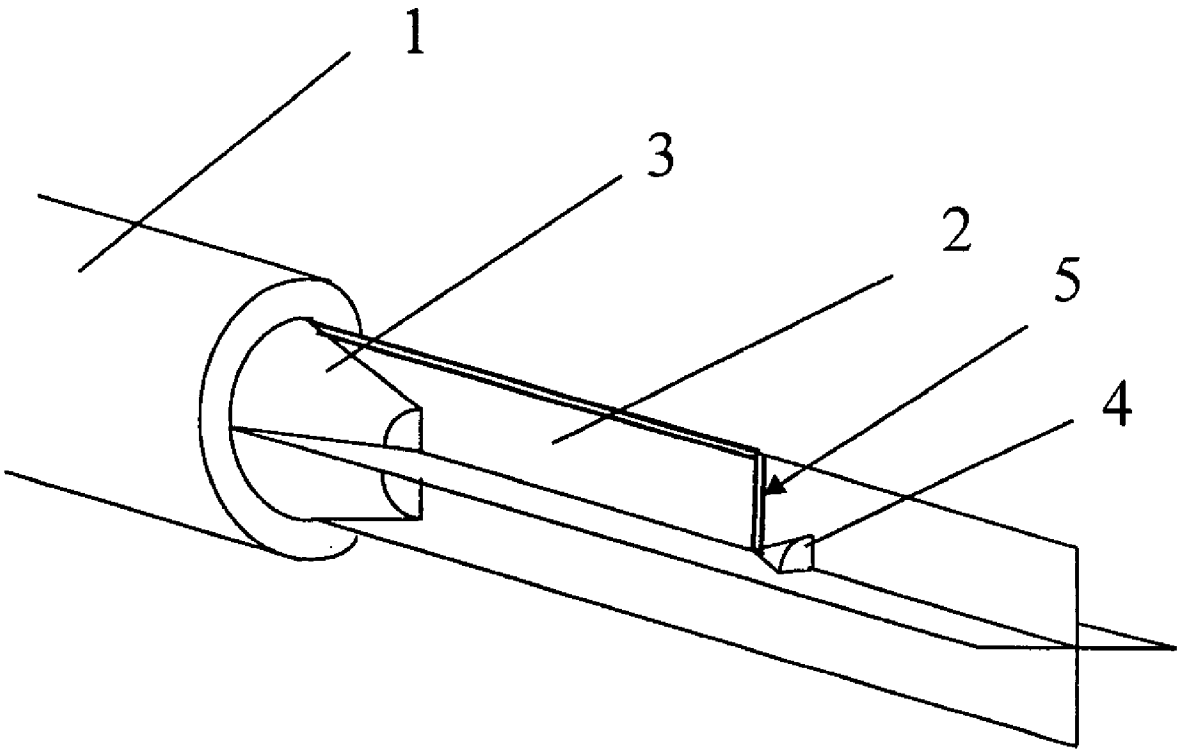
FIG. 2 illustrates the IR radiator from FIG. 1 with an additional flame holder.

FIG. 2 depicts schematically the arrangement of FIG. 1 with a further advantageous construction in which a flame holder 4 is fastened on the IR radiator 2. Using the flame holder 4, it is possible to generate a flame (not represented) that heats the IR radiator 2 locally. In this way, the temperature of the IR radiator 2, and consequently the IR irradiation, can be influenced individually. The flame holder 4 can moreover be arranged on IR radiator 2 at a specifiable distance from the turbine 1. Supplying the flame holder 4 can, for example, take place using temperature-resistant supply lines that lead into the interior of the flying device. Liquid fuel or gas fuel can be used to generate the flame in flame holder 4.

Figure 3B:
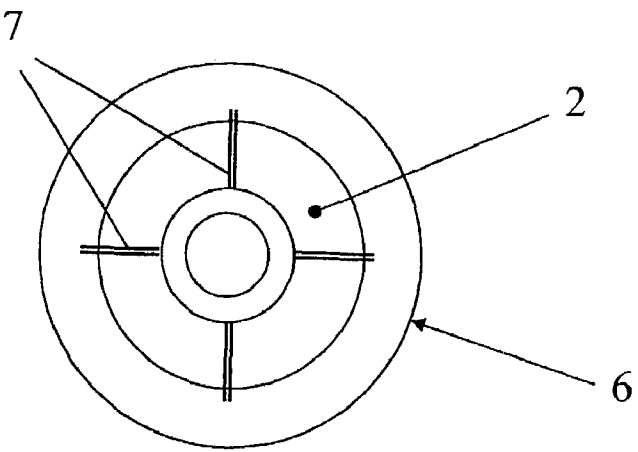
FIGS. 3*a* and 3*b* show the arrangement of an IR radiator in the exhaust stream of a heat-generating unit in a perspective lateral view in a second design.
Figure 3A:
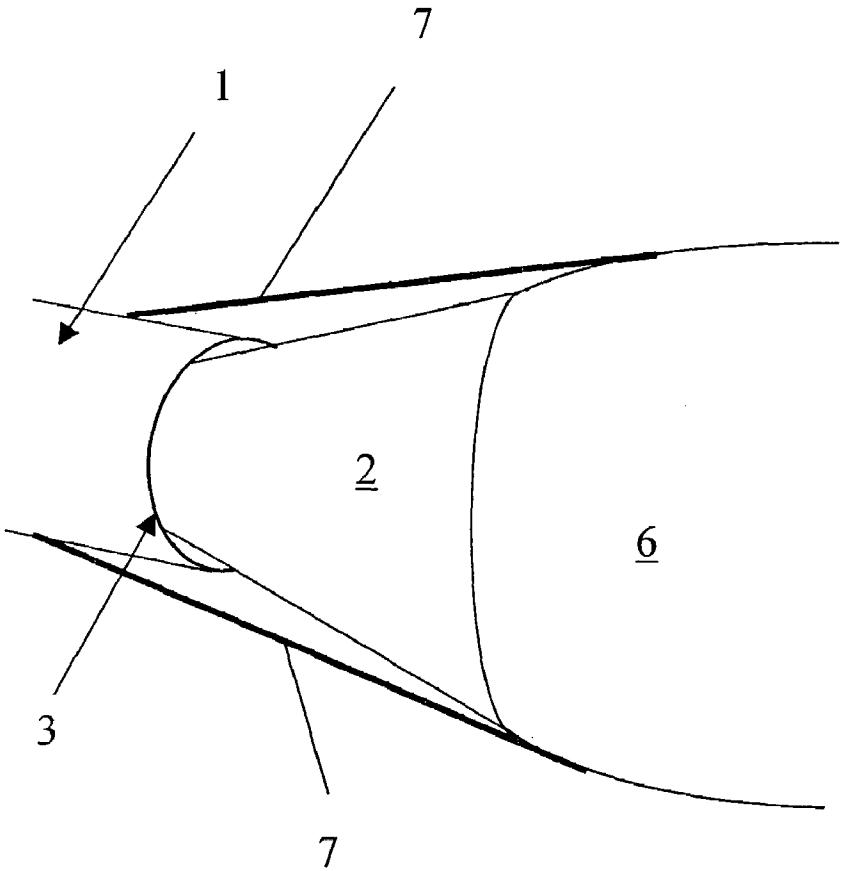

FIG. 3*a* shows schematically in perspective elevation a second design of the arrangement of an IR radiator 2 in the exhaust stream of a heat-generating unit 1, for example an aircraft gas turbine. The turbine 1 and the IR radiator 2 are positioned axially at a specified distance in front of the nose of the flying device. Turbine 1 is joined using support poles 7 with the fuselage of the flying device 6. The support poles 7 can in particular be configured aerodynamically so that they form only slight aerodynamic resistance when the flying device is in flight.

A nozzle 3, for example, a ring nozzle, is arranged at the outlet of turbine 1. The conical IR radiator 2 is appropriately fastened on the nozzle 3. The exhaust of turbine 1 consequently flows out of the ring nozzle 3 and is diverted laterally from the conical IR radiator 2 according to the generating angle of the cone such that a resulting thrust still remains for the flying device 6. At the same time the conical IR radiator 2 is heated by the exhaust gas. The exhaust gas thus flows around the overall cone of the IR radiator 2 and therefore prevents a cooling of the IR radiator by the slipstream during flight operation.

The IR radiator 2 in this representation is a conical component that is fastened on the nose of the flying device 6. It is also possible for the nose of the flying device 6 to be constructed conically and to form the IR radiator 2. In both cases, the IR radiator 2 has only minor aerodynamic resistance.

FIG. 3*b* provides presents a schematic frontal view of FIG. 3*a*. From this, it should be recognized that with this arrangement, forward IR irradiation is possible in the direction of flight of the flying device 6. The IR irradiation is only negligibly diminished by the turbine 1 and the support poles 7. Above and beyond this, IR irradiation toward the side is also possible according to the generating angle of the cone.

Figure 4:
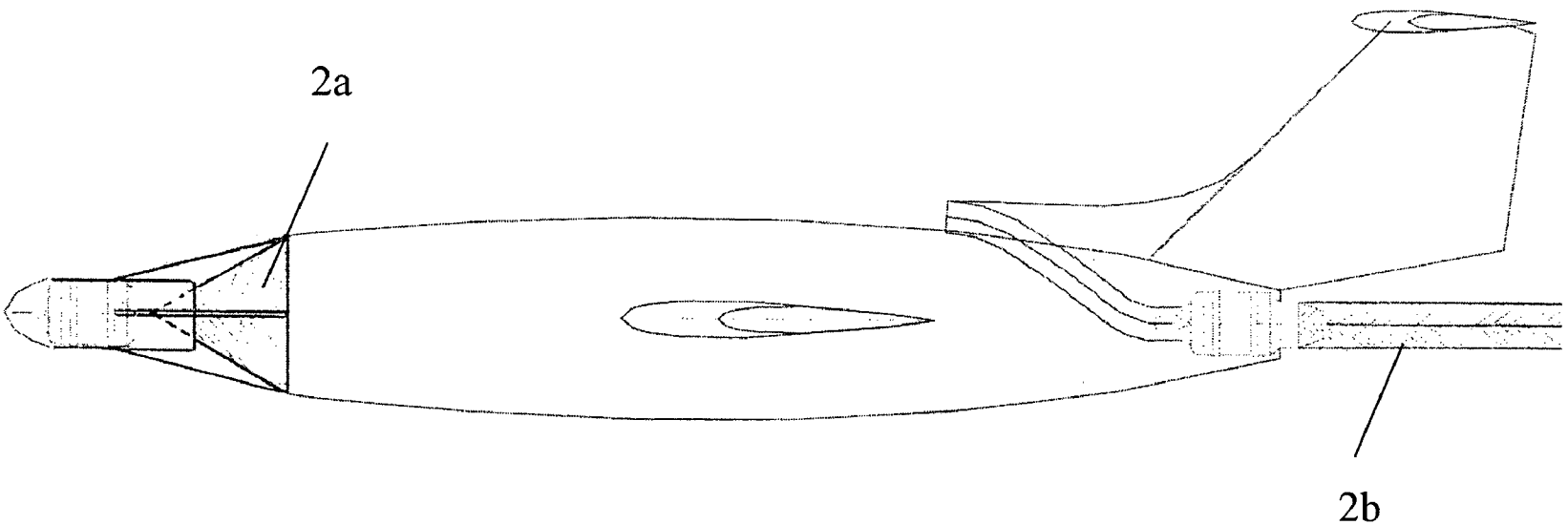
FIG. 4 shows in elevation a flying device of the invention with an IR radiator situated in front of the nose and on the tail.

FIG. 4 shows in side view a flying device of the invention, which by way of example has an IR radiator 2*a* on the nose and an IR radiator 2*b* on the tail.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A flying device for IR flying target representation, said device comprising:

a heat-generating unit spaced apart from and proximal to a nose of a propulsion unit wherein said nose has a conical shape and functions as an infrared radiator with said nose being arranged in an exhaust stream of said heat generating unit to thereby provide infrared radiation forward in a direction of flight of the flying device.

2. The flying device according to claim 1, wherein the infrared radiator is made of one or more temperature-resistant materials.

3. The flying device according to claim 1, wherein the surface of the infrared radiator has a high emission capacity in the infrared spectral range.

4. The flying device according to claim 3, wherein that the surface of the infrared radiator is coated with electric insulating materials.

5. The flying device according to claim 1, wherein the propulsive unit is one of an aircraft gas turbine, an internal combustion motor and a gas burner.

6. A flying device for IR flying target representation comprising;

a first component including a conically shaped infrared radiator arranged on a front end of said first component and a propulsion device;

a second component including a heat-generating unit connected to and spatially separated from said first component, said heat generating unit extending in a lateral direction from said front end of said first component wherein said conically shaped infrared radiator is arranged in an exhaust stream of said heat generating unit and provides infrared radiation forward in a direction of flight of said flying device.

7. The flying device according to claim 6, wherein the infrared radiator is made of one or more temperature-resistant materials.

8. The flying device according to claim 6, wherein the surface of the infrared radiator has a high emission capacity in the infrared spectral range.

9. The flying device according to claim 8, wherein that the surface of the infrared radiator is coated with electric insulating materials.

10. The flying device according to claim 6, wherein the heat generating unit is one of an aircraft gas turbine, an internal combustion motor and a gas burner.

* * * * *